US005979215A

United States Patent [19]

Lefavour et al.

[11] Patent Number: 5,979,215

[45] Date of Patent: Nov. 9, 1999

[54] HYDRAULIC TOOL WITH RAPID RAM ADVANCE

[75] Inventors: John D. Lefavour, Litchfield; Armand T. Montminy, Manchester, both of N.H.

[73] Assignee: Framatome Connectors USA Inc., Fairfield, Conn.

[21] Appl. No.: 09/172,511

[22] Filed: Oct. 14, 1998

[51] Int. Cl.[6] ..... B21D 7/06

[52] U.S. Cl. ..... 72/453.16; 72/453.02; 137/454.5; 60/479

[58] Field of Search ..... 72/453.16, 416, 72/453.15, 453.18, 453.02; 137/454.5; 60/477, 479

[56] References Cited

U.S. PATENT DOCUMENTS 4,226,110 10/1980 Suganuma ..... 72/416
4,339,942 7/1982 Svensson ..... 72/453.16
4,823,588 4/1989 Bussereau et al. ..... 72/453.16
4,942,757 7/1990 Pecora ..... 72/453.16
4,947,672 8/1990 Pecora et al. ..... 72/453.16

*Primary Examiner*—David Jones
*Attorney, Agent, or Firm*—Perman & Green, LLP

[57] ABSTRACT

A hydraulic tool having a frame, a conduit system in the frame, a pump in the conduit system, a ram movably connected to the frame, and a mechanical actuator provided in the conduit system for contacting a rear end of the ram. The conduit system is adapted to conduit hydraulic fluid from the pump against both the rear end of the ram and a rear end of the mechanical actuator.

15 Claims, 5 Drawing Sheets

HYDRAULIC TOOL WITH RAPID RAM ADVANCE

BACKGROUND OF THE INVENTION

1. Field of the Invention

The present invention relates to hydraulic tools and, more particularly, to a tool having a rapid ram advance feature.

2. Prior Art

U.S. Pat. Nos. 4,942,757 and 4,947,672, which are hereby incorporated by reference, disclose hydraulic tools with movable rams. The Burndy Electrical division of Framatome Connectors USA Inc. sells a hand operated hydraulic tool, type Y750 which has a rapid advance two stage pump and a type Y35 with a rotatable handle for rapid ram advance.

SUMMARY OF THE INVENTION

In accordance with one embodiment of the present invention, a hydraulic compression tool is provided having a frame, a hydraulic fluid reservoir connected to the frame, a ram movably connected to the frame, the ram having a rear end hydraulic fluid contact surface, a conduit system in the frame between the reservoir and the ram, and a pump provided in the conduit system. The improvement comprises a mechanical actuator provided in the conduit system for contacting the rear end of the ram. The conduit system is adapted to conduit hydraulic fluid from the pump against both the rear end of the ram and a rear end of the mechanical actuator.

In accordance with another embodiment of the present invention, a hydraulic compression tool is provided having a frame, a hydraulic fluid reservoir connected to the frame, a ram movably connected to the frame and forming a ram hydraulic chamber with the frame, the ram having a rear end hydraulic fluid contact surface, a conduit system in the frame between the reservoir and the ram hydraulic chamber, and a pump in the conduit system. The improvement comprises a multispeed ram advancement system for advancing the ram at two different rates of movement on the frame for a same stroke length of the pump. The advancement system comprises a rapid advance actuator connected by the conduit system to the pump. The actuator is adapted to push directly against the rear end of the ram. A suction conduit section of the conduit system is located between the reservoir and the ram hydraulic chamber to transport hydraulic fluid directly from the reservoir to the ram hydraulic chamber when the ram is being advanced by the rapid advance actuator.

In accordance with one method of the present invention, a method of advancing a ram in a hydraulic compression tool is provided comprising steps of actuating a pump of the tool to move the ram relative to a frame of a tool at a first rate of movement comprising pushing hydraulic fluid against a first pushing surface connected to the ram to push the ram forward; and actuating the pump to move the ram relative to the frame at a second slower rate of movement comprising pushing hydraulic fluid against a second larger pushing surface of the ram to push the ram forward.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
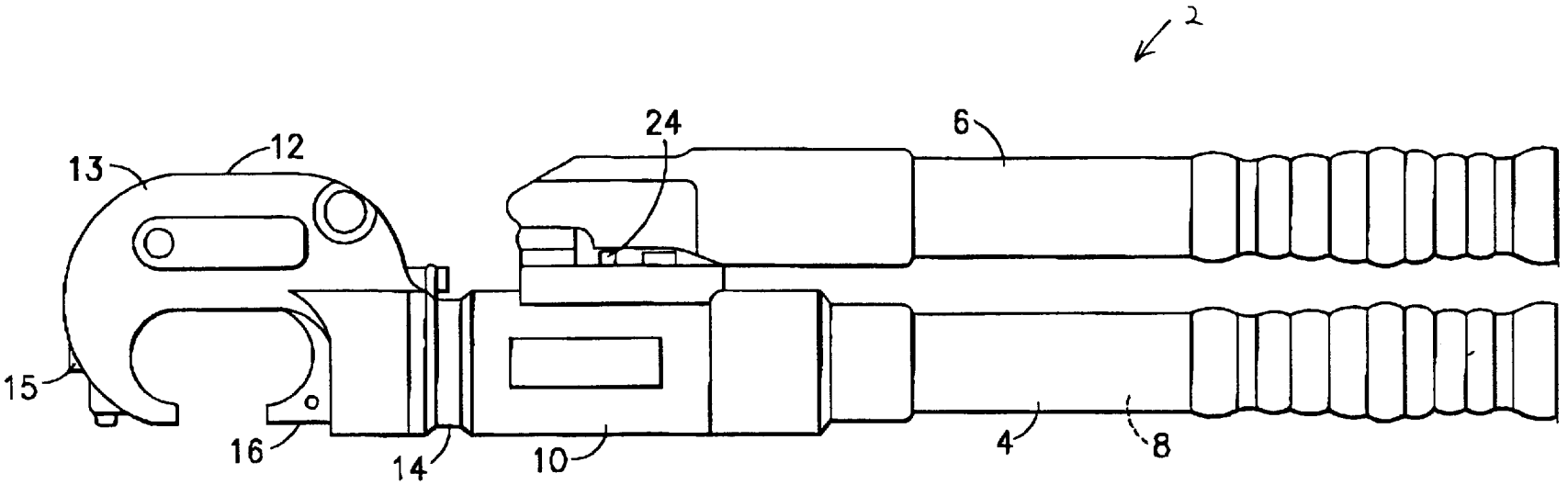
FIG. 1 is an electrical side view of a hydraulic tool incorporating features of the present invention.

Referring to FIG. 1, there is shown an elevational side view of a hydraulic tool 2 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The tool 2 generally comprises a first handle 4 having a fluid reservoir 8 therein, a second handle 6, a body 10 and a compression head 12. The reservoir 8 is generally capable of holding a supply of hydraulic fluid, such as oil, and capable of supplying the fluid to the body 10. In the embodiment shown, the reservoir 8 is partially formed from a portion of the body 10. The second handle 6 is pivotally mounted to the body 10 for operating a hydraulic pump 24. The compression head 12 generally comprises a cylinder body 14 with a ram or piston 16 movably mounted therein and a frame 13 with clamping section 15. The clamping section 15 and the ram 16 each also comprises means for mounting two dies (not shown) for compressing articles such as metal connectors about elements, such as wires. These dies are removable from the compression head 12 such that the compression head 12 can accommodate different types of dies for different connectors. The handles 4, 6 can be manipulated to operate the hydraulic pump 24 for providing fluid from the fluid reservoir 8 in the first handle 4 to provide high pressure hydraulics to advance the ram 16.

Figure 2:
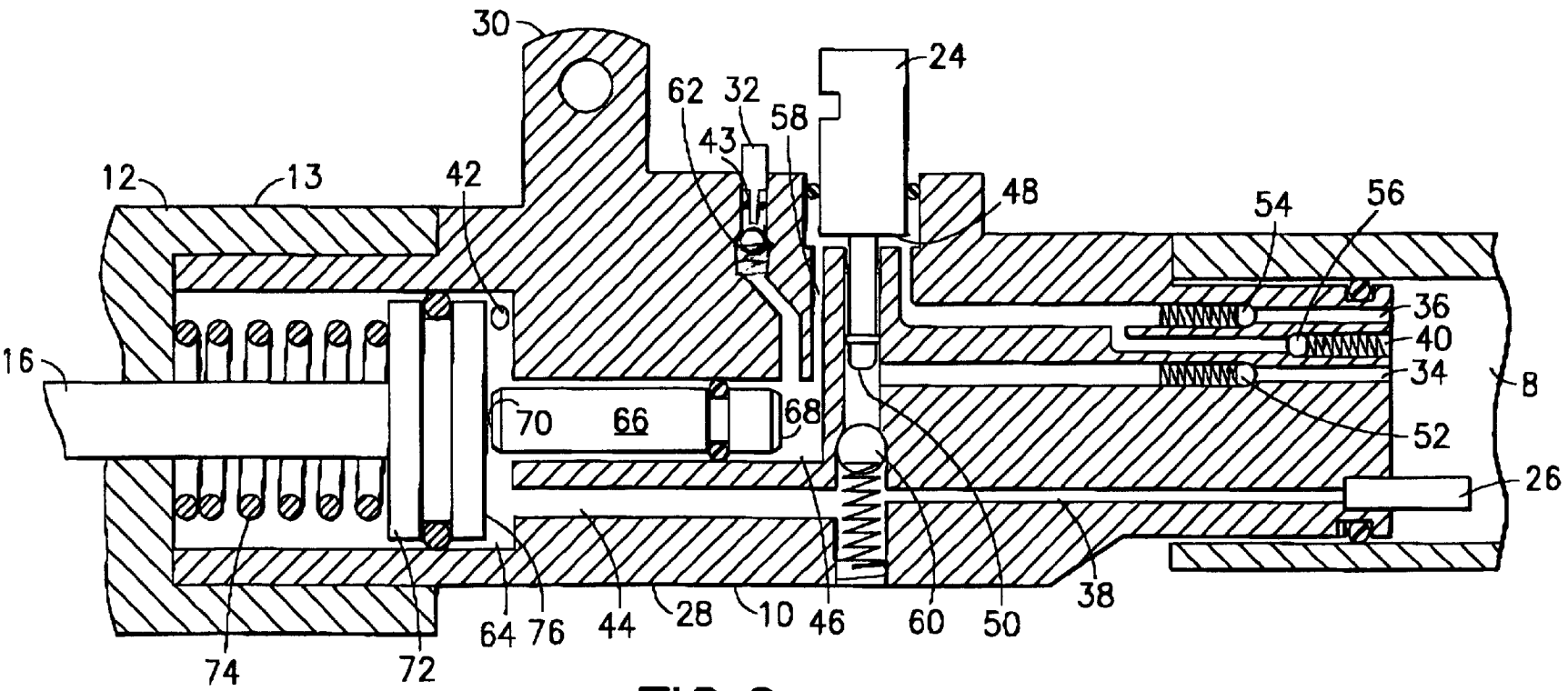
FIG. 2 is a partial cross-sectional view of the tool shown in FIG. 1.
Figure 3:
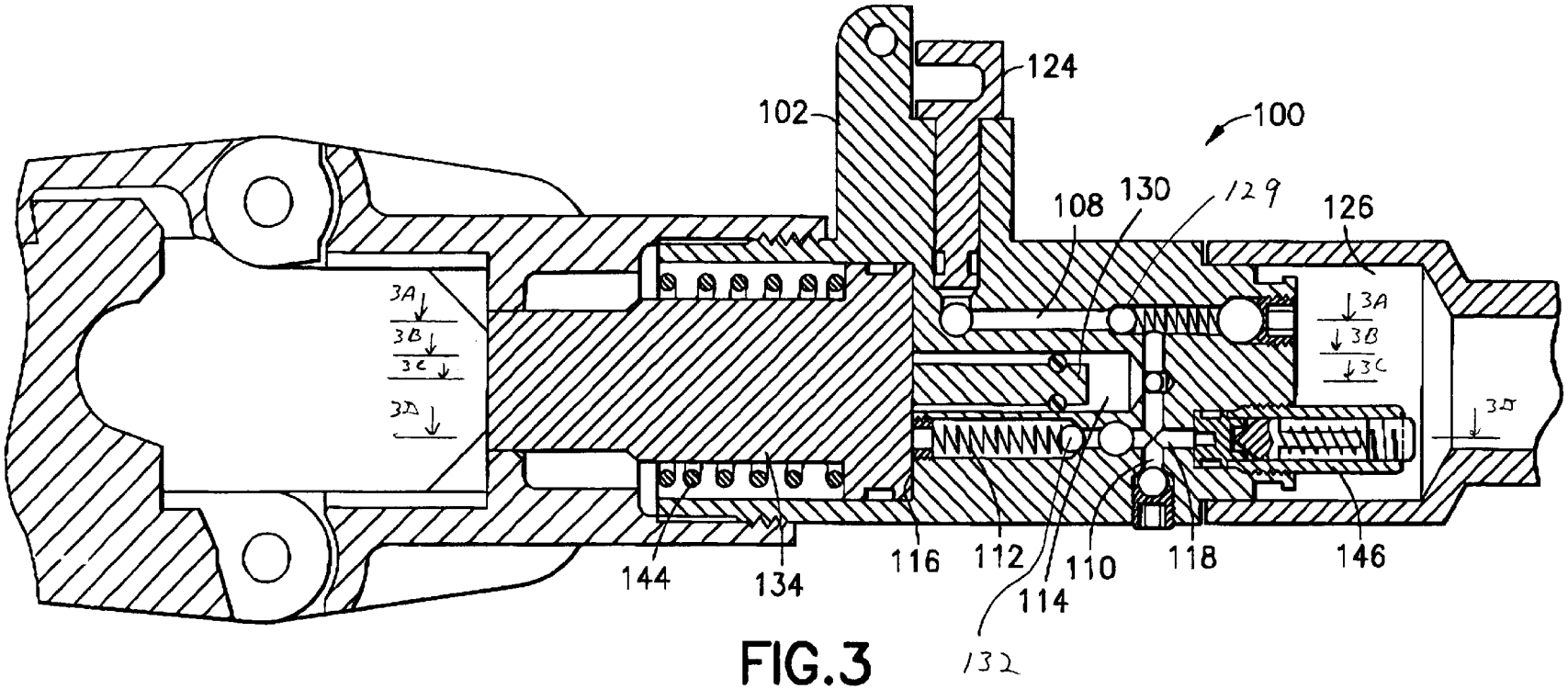
FIG. 3 is a partial cross-sectional view similar to FIG. 2 of an alternate embodiment of the tool.
Figure 3A:
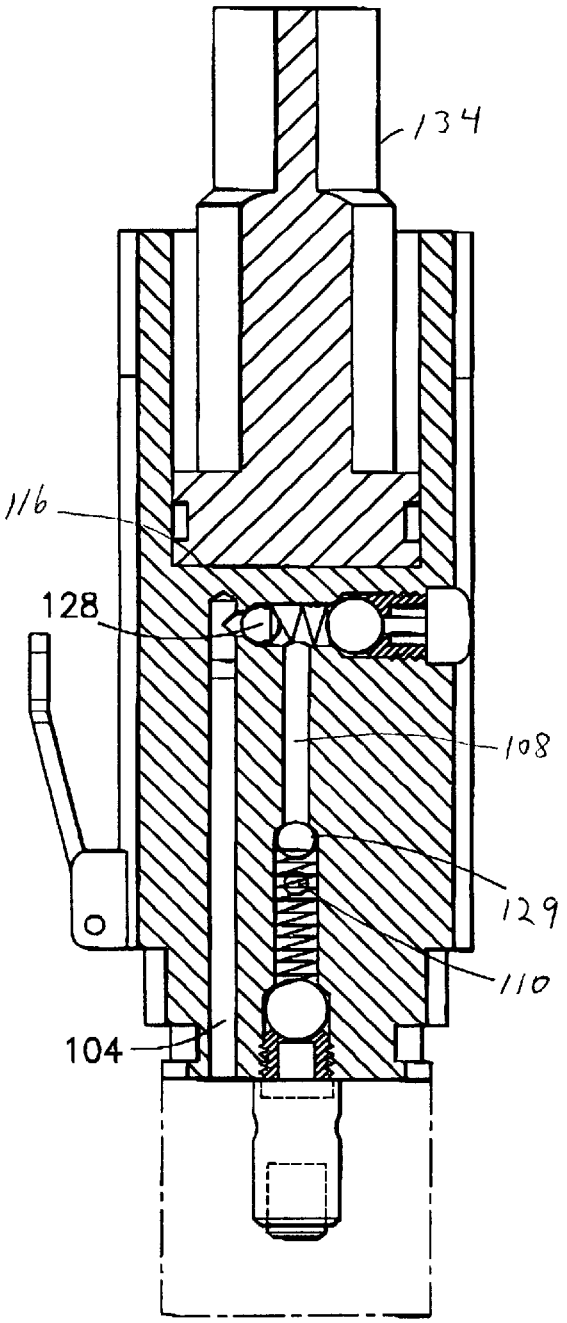
FIG. 3A is a partial cross-sectional view of the tool shown in FIG. 3 taken along line 3A—3A.
Figure 3B:
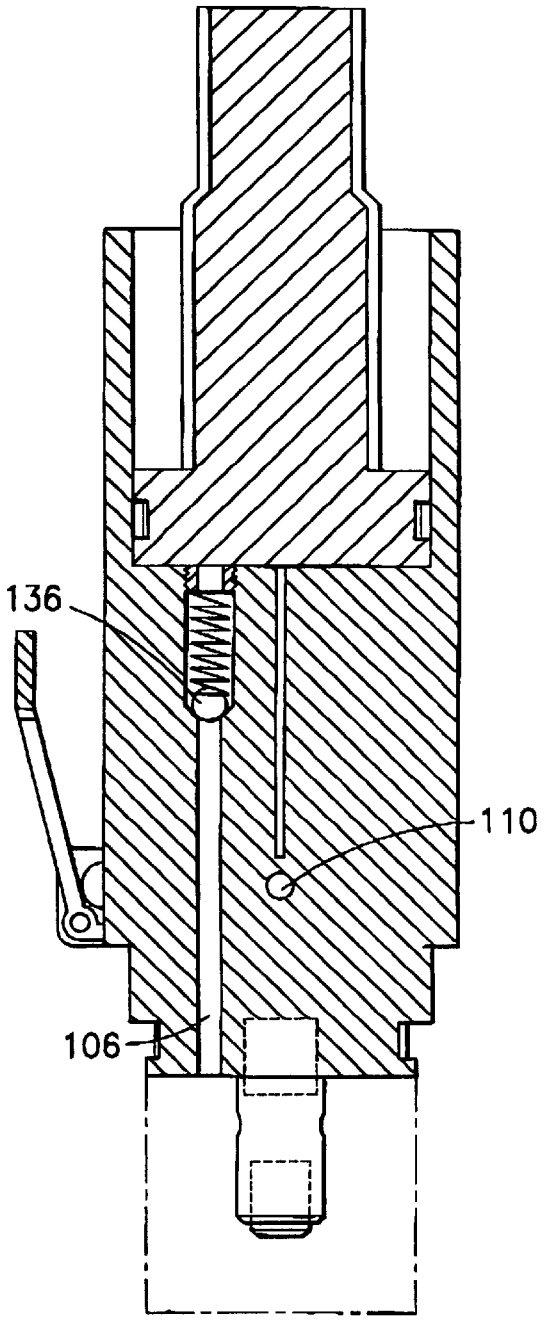
FIG. 3B is a partial cross-sectional view of the tool shown in FIG. 3 taken along line 3B—3B.
Figure 3C:
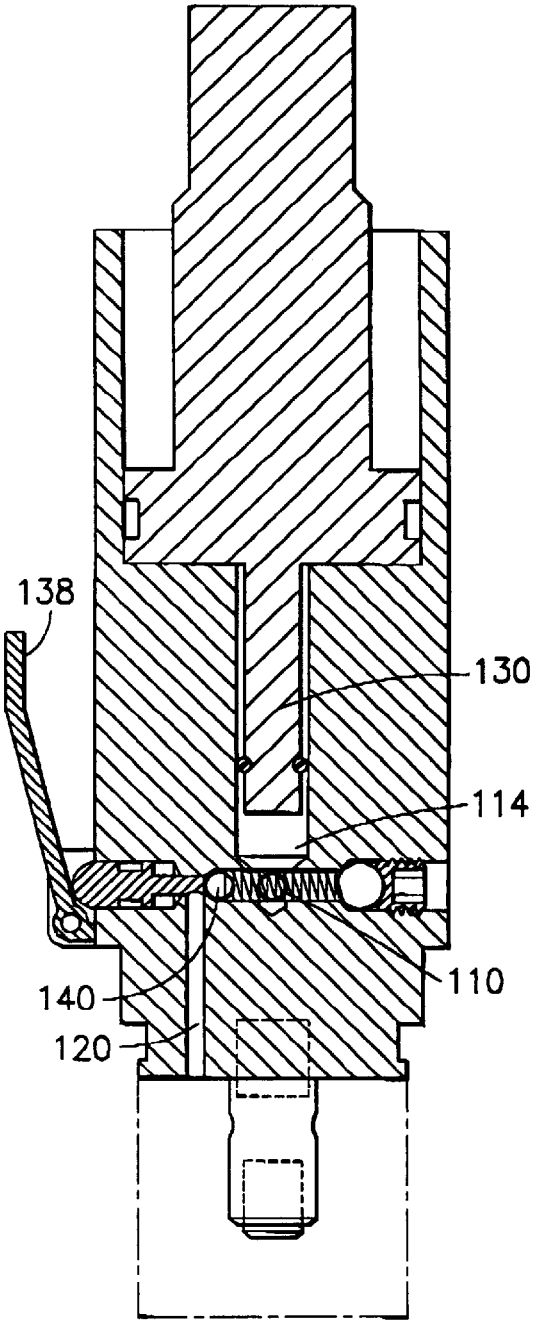
FIG. 3C is a partial cross-sectional view of the tool shown in FIG. 3 taken along line 3C—3C.
Figure 3D:
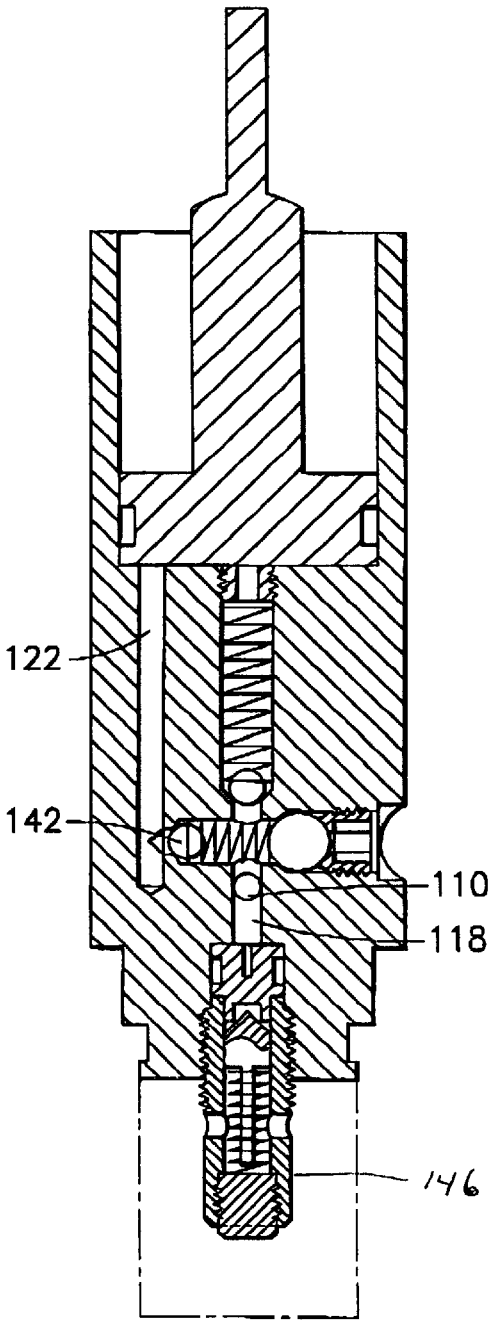
FIG. 3D is a partial cross-sectional view of the tool shown in FIG. 3 taken along line 3D—3D.

Referring also to FIG. 2, the body 10 of the tool will be further described. The body 10 generally comprises a frame 28, the hydraulic pump 24, the relief valve 26, a release valve 32, and a plurality of conduits forming a supply conduit system and a return conduit system as will be described below. The frame 28 has a pivot arm 30 which is provided for connecting the second handle 6 to the body 10.

In this embodiment the conduit system generally comprises two suction conduits 34, 36, four return conduits 38, 40, 42, 43, two supply conduits 44, 58, and an actuator conduit 46. In alternate embodiments more or less conduits could be provided and/or other conduit system configurations could be provided. Various check valves are provided in the conduits. The pump 24 is connected to the conduit system. In this embodiment the pump 24 is a coaxial two stage pump with a movable plunger having two separate hydraulic fluid pushing surfaces 48, 50. The first suction conduit 34 extends from the reservoir 8 to a portion of the conduit system having the inner pushing surface 50. The first suction conduit 34 has the check valve 52. The second suction conduit 36 extends from the reservoir 8 to a portion of the conduit system having the outer pushing surface 48. The second suction conduit has the check valve 54. The first return conduit 40 extends from the second suction conduit 36 to the reservoir 8 and has the check valve 56. The supply conduit 58 extends from the outer pushing surface 48 to the actuator conduit 46. The supply conduit 44 is connected to the portion of the conduit system having the inner pushing surface 50 through the check valve 60. The return conduit 43 extends to the reservoir 8. A check valve 62 between the actuator conduit 46 and the return conduit 43 can be manually opened by depressing the release valve 32. The return conduit 42 extends from the ram hydraulic chamber 64, through a mechanical drain check valve (not shown), to the reservoir 8. The return conduit 38 extends to the reservoir 8 and has the relief valve 26 therein.

The tool 2 has a mechanical actuator 66 movably located in the actuator conduit 46. The actuator 66 has a rear end 68, adapted to have hydraulic fluid press thereagainst, and a front end 70. The ram 16 has a rear end 72 located in the ram hydraulic chamber 64. A ram spring 74 biases the rear end 72 in a rearward direction. The rear end 72 has a rear end surface 76 that functions both as a hydraulic fluid contact surface and a surface which the front end 70 of the actuator 66 directly contacts and pushes against.

The tool 2 uses a system to move the ram 16 at two different rates of movement, depending upon hydraulic fluid pressure in the ram hydraulic chamber 64, for a same stroke of the pump 24 and a same relative movement of the handles 4, 6. In particular, the ram movement system first moves the ram 16 forward relatively quickly, until resistance is encountered when the ram makes contact with an article in the compression head 12, and then moves forward relatively slowly, but with greater force. However, both rates of movement are provided by the same motion of the pump 24.

The first rate of movement uses hydraulic pressure to move the actuator 66 forward which, in turn, directly pushes against and moves forward the ram 16. As the pump 24 is moved outward, when the handle 6 is pivoted outward, hydraulic fluid from the reservoir 8 is pulled into the conduit system through the suction conduits 34, 36. On the inward stroke of the pump 24, when the handle 6 is pivoted inward, hydraulic fluid is pushed by the outer pushing surface 48 of the pump 24 through the supply conduit 58 into the actuator conduit 46. This pushes against the rear end 68 of the actuator 66 to move the actuator forward. In one embodiment, the area of the rear end 68 is about the same as the area of the outer surface 48. Thus, the forward movement of the actuator 66 is about equal to the stroke length of the pump 24, such as about one inch. However, any suitable ratio of hydraulic fluid pushing surfaces could be provided. Because the front end 70 of the actuator 66 is in direct contact with the rear end surface 76 of the ram 16, the ram 16 is moved forward an equal distance with the actuator 66. Thus, for example, if the actuator 66 is moved forward one inch with a single stroke of the pump 24 during this first stage or rate of operation, the ram 16 is also moved forward one inch with a single stroke of the pump 24. Hydraulic fluid can be sucked through the conduits 34, 44 into the chamber 64 as the ram 16 is moved forward during this first stage of operation. Alternatively, a separate or different conduit could be used to fill the rapidly enlarging volume of the chamber 64 as the ram 16 is moved forward during this first rate of movement.

When the ram 16 encounters an enlarged resistance to forward movement based upon encountering an article in the compression head 12, such as a connector to be crimped onto a conductor, the ram movement system automatically switches to a second stage or rate of operation. More specifically, the pump 24 still functions in the same manner of moving in and out, however, the ram 16 is no longer pushed forward by the mechanical actuator 66. Instead, the ram 16 is now pushed forward by hydraulic fluid pressure pushing against its rear end surface 76. As the pump 24 is moved outward hydraulic fluid is pulled in through the conduits 34, 36 similar to the first stage of movement. However, in the inward stroke of the pump 24 hydraulic pressure in the chamber 64 is larger than that generated by the outer pushing surface 48. Therefore, the actuator 66 does not move forward. Instead, the check valve 56 is pushed open to allow the hydraulic fluid from the outer pushing surface 48 to return to the reservoir 8. Also during this inward stroke of the pump 24, the inner pushing surface 50 of the pump 24, which is smaller than the surface 48, pushes hydraulic fluid through the check valve 60, supply conduit 44, and into the chamber 64. The size of the surface 50 is much smaller than the size of the surface 76, such as 1/100 smaller. Therefore, the ram 16 moves forward slower for each stroke of the pump 24 during the second rate of movement than the first rate of movement, such as 1/100 inch per pump stroke. However, greater force can be exerted against the ram 16 to thereby exert a larger force on the member in the compression head. If pressure in the chamber 64 becomes too large, the relieve valve 26 will open. After forward movement of the ram 16 is complete, such as after completion of crimping a connector onto a conductor, the release valves are opened to allow hydraulic fluid to flow from the chamber 64 and conduit 46, through the conduits 42, 43, and back to the reservoir 8. The spring 74 pushes the ram 16 back to its rear position which, in turn, pushes the actuator 66 back to its rear position.

Two stage pumps, such as the coaxial pump described in U.S. Pat. No. 4,947,672, have been used in the past to combat slow ram advancement. The present system can be used with either a single stage pump or a two stage pump, but in either event achieve a faster movement of the ram to its high pressure crimping or cutting position. A comparison of two prior art tools (one with a single stage pump and one with a two stage pump) will now be given relative to a tool having a single stage pump with the present invention.

For a prior art tool with a single stage pump having a 0.25 inch diameter, a single stage pump stroke length of 0.60 inch, and a ram diameter of 2 inches, the volume ratio of ram chamber volume to pump volume would be 106:1. Thus, to move the ram 1 inch, the operator would need to pump the tool 106 times. For a prior art tool with a two stage pump having a 0.25 inch inner diameter, 0.70 inch outer diameter, two stage pump stroke length of 0.60 inch, and a ram diameter of 2 inches, the volume ratio during low pressure ram movement would be 13.6:1. Thus, to move the ram 1 inch during low pressure ram movement, the operator would need to pump the tool 13.6 times. For a tool having the present invention and a single stage pump with a 0.25 inch diameter, a single stage pump stroke length of 0.60 inch, and an actuator diameter of 0.30 inch, the volume ratio of actuator conduit volume to pump volume would be 2.4:1. Thus, the operator would have to pump the tool 2.4 times to achieve low pressure actuator advancement of 1 inch. Because the ratio of ram advancement to actuator advancement is 1:1, the ram would be advanced 1 inch with merely 2.4 pumps or strokes of the pump. This is obviously faster and easier than could be provided in the prior art tools. The number of high pressure strokes to compress or crimp an article would be the same for all three tools. For the tool 2 shown in FIG. 2 with a two stage pump having an inner diameter of 0.25 inch, an outer diameter of 0.70 inch, a two stage pump stroke length of 0.60 inch, and an actuator diameter of 0.30 inch the volume ratio of actuator conduit volume to pump volume would be about 0.3:1. Thus, an operator would merely need to pump the handles 0.3 times (or about ⅓ of a pump) for the ram to travel 1 inch during low pressure operation.

Referring now to FIGS. 3 and 3A–3D a tool 100 having a single stage pump and features of the present invention will be described. The tool 100 has a body 102 with two suction conduits 104, 106, three supply conduits 108, 110, 112, a mechanical actuator conduit/chamber 114, a ram hydraulic chamber 116, and three return conduits 118, 120, 122. Upon the outward stroke of the pump plunger 124 hydraulic fluid is pulled from the reservoir 126 through the first suction conduit 104 past the first check valve 128. During the low pressure operation of the tool, when the plunger 124 is moved inward, the hydraulic fluid is pushed through the first two supply conduits 108, 110 past the second check valve 129 into the actuator chamber 114 to push the actuator 130 forward. The third check valve 132, due to a proper selection of its spring strength, prevents the fluid from passing through the third supply conduit 112 at this low pressure stage. The front end of the actuator 130 directly contacts and pushes the ram 134 forward.

Hydraulic fluid is sucked through the second suction conduit 106 from the reservoir 126, past the fourth check valve 136, into the ram hydraulic chamber 116. When hydraulic pressure increases past a predetermined amount for the third check valve 132 to open during pumping, the hydraulic fluid is then pumped through the third supply conduit 112 into the ram hydraulic chamber 116 to move the ram at the high pressure slower mode. When the compression operation is completed, the operator can depress the lever 138 to open the release valve 140 (see FIG. 3C). This allows hydraulic fluid to flow from the chamber 114 out the conduits 110, 120 and flow from the chamber 116 out the conduits 122, past check valve 142, and out the conduits 110, 120 to the reservoir 126 (see FIG. 3D). Spring 144 pushes the ram 134 and actuator 130 back to their rearward positions. Relieve valve 146 can allow excessively high pressure to blow off into the reservoir.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a hydraulic compression tool having a frame, a hydraulic fluid reservoir connected to the frame, a ram movably connected to the frame, the ram having a rear end hydraulic fluid contact surface, a conduit system in the frame between the reservoir and the ram, and a pump provided in the conduit system, wherein the improvement comprises:

a mechanical actuator provided in the conduit system for contacting the rear end of the ram, wherein the conduit system is adapted to conduit hydraulic fluid from the pump against both the rear end of the ram and a rear end of the mechanical actuator.

2. A tool as in claim 1 wherein the pump comprises a plunger with a single hydraulic fluid pushing surface.

3. A tool is in claim 1 wherein the pump comprises a plunger with two separate hydraulic fluid pushing surfaces to provide a two-stage pump.

4. A tool as in claim 3 wherein the conduit system comprises a first conduit from a first one of the plunger pushing surfaces to the rear end of the mechanical actuator and a second conduit from a second one of the plunger pushing surfaces to the rear end of the ram.

5. A tool as in claim 1 wherein the conduit system comprises a suction conduit between the reservoir and the rear end of the ram wherein hydraulic fluid can be sucked from the reservoir into an area behind the ram when the ram is pushed forward by the mechanical actuator.

6. A tool as in claim 1 wherein the mechanical actuator is a separate member from the ram and the ram is adapted to move forward on the frame separate from the mechanical actuator.

7. A tool as in claim 1 wherein the rear end of the mechanical actuator is sized relative to the pump to move the ram a maximum ram stroke distance with less than about 3 strokes of the pump.

8. In a hydraulic compression tool having a frame, a hydraulic fluid reservoir connected to the frame, a ram movably connected to the frame and forming a ram hydraulic chamber with the frame, the ram having a rear end hydraulic fluid contact surface, a conduit system in the frame between the reservoir and the ram hydraulic chamber, and a pump in the conduit system, wherein the improvement comprises:

a multi-speed ram advancement system for advancing the ram at two different rates of movement on the frame for a same stroke length of the pump, the advancement system comprising a rapid advance actuator connected by the conduit system to the pump, the actuator being adapted to push directly against the rear end of the ram, and a suction conduit section of the conduit system between the reservoir and the ram hydraulic chamber to transport hydraulic fluid directly from the reservoir to the ram hydraulic chamber when the ram is being advanced by the rapid advance actuator.

9. A tool as in claim 8 wherein the pump comprises a plunger with a single hydraulic fluid pushing surface.

10. A tool is in claim 8 wherein the pump comprises a plunger with two separate hydraulic fluid pushing surfaces to provide a two-stage pump.

11. A tool as in claim 10 wherein the conduit system comprises a first conduit from a first one of the plunger pushing surfaces to the rear end of the actuator and a second conduit from a second one of the plunger pushing surfaces to the rear end of the ram.

12. A tool as in claim 8 wherein the actuator is a separate member from the ram and the ram is adapted to move forward on the frame separate from the actuator.

13. A tool as in claim 8 wherein the rear end of the actuator is sized relative to the pump to move the ram a maximum ram stroke distance with less than about 3 strokes of the pump.

14. A method of advancing a ram in a hydraulic compression tool comprising steps of:

actuating a pump of the tool to move the ram relative to a frame of the tool at a first rate of movement comprising pushing hydraulic fluid against a first pushing surface connected to the ram to push the ram forward; and actuating the pump to move the ram relative to the frame at a second slower rate of movement comprising pushing hydraulic fluid against a second larger pushing surface of the ram to push the ram forward, wherein the pump is a two-stage pump with two hydraulic fluid pushing surfaces, wherein one of the pump pushing surfaces is connected by a conduit system of the tool to the first pushing surface and the other pump pushing surface is connected by the conduit system to the second pushing surface.

15. A method of advancing a ram in a hydraulic compression tool comprising steps of:

actuating a pump of the tool to move the ram relative to a frame of the tool at a first rate of movement comprising pushing hydraulic fluid against a first pushing surface connected to the ram to push the ram forward; and actuating the pump to move the ram relative to the frame at a second slower rate of movement comprising pushing hydraulic fluid against a second larger pushing surface of the ram to push the ram forward, wherein the first and second pushing surfaces move together during the ram first rate of movement and the first and second pushing surfaces do not move together during the ram second rate of movement.

* * * * *